US007498908B2

(12) United States Patent
Gurov

(10) Patent No.: US 7,498,908 B2
(45) Date of Patent: Mar. 3, 2009

(54) HIGH-POWER PIN DIODE SWITCH

(75) Inventor: Gennady G. Gurov, Loveland, CO (US)

(73) Assignee: Advanced Energy Industries, Inc, Fort Collins, CO (US)

( * ) Notice: Subject to any disclaimer, the term of this patent is extended or adjusted under 35 U.S.C. 154(b) by 301 days.

(21) Appl. No.: 11/462,649

(22) Filed: Aug. 4, 2006

(65) Prior Publication Data

US 2008/0030285 A1 Feb. 7, 2008

(51) Int. Cl.
*H01P 1/15* (2006.01)
*H01P 5/16* (2006.01)

(52) U.S. Cl. ..... 333/262; 327/503

(58) Field of Classification Search ..... 333/103, 333/104, 246, 219, 262; 327/503
See application file for complete search history.

(56) References Cited

U.S. PATENT DOCUMENTS

| | | | | |
|---|---|---|---|---|
| 4,220,874 | A | 9/1980 | Iwata | |
| 4,626,806 | A | 12/1986 | Rosar | |
| 5,095,357 | A * | 3/1992 | Andoh et al. | 257/379 |
| 5,193,218 | A | 3/1993 | Shimo | |
| 5,440,283 | A | 8/1995 | Nendza | |
| 5,584,053 | A | 12/1996 | Kommrusch | |
| 5,594,394 | A | 1/1997 | Sasaki | |
| 5,760,456 | A * | 6/1998 | Grzegorek et al. | 257/531 |
| 6,011,450 | A | 1/2000 | Miya | |
| 6,014,066 | A | 1/2000 | Harberts et al. | |
| 6,251,707 | B1 | 6/2001 | Bernier et al. | |
| 6,552,626 | B2 | 4/2003 | Sharpe | |
| 6,556,099 | B2 * | 4/2003 | Khan et al. | 333/34 |
| 6,677,828 | B1 | 1/2004 | Harnett | |
| 6,697,605 | B1 | 2/2004 | Atokawa | |

FOREIGN PATENT DOCUMENTS

WO 0120792 3/2001

OTHER PUBLICATIONS

Doherty, Bill; *PIN DIODE Fundamentals*; RF Globalnet News; Mar. 16, 2006; http://www.rfglobalnet.com/content/news/article.asp?docid+%7B865681ce-39ec-46c5-a05.
ISA/US, International Search Report, Aug. 21, 2008, USA.

* cited by examiner

*Primary Examiner*—Benny Lee
*Assistant Examiner*—Alan Wong

(57) ABSTRACT

A high-power PIN diode switch for use in applications such as plasma processing systems is described. One illustrative embodiment comprises an input terminal; an output terminal; and first and second transmission-line elements connected in parallel to the input and output terminals, each of the first and second transmission-line elements including a thermoconductive dielectric substrate and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections.

19 Claims, 7 Drawing Sheets

HIGH-POWER PIN DIODE SWITCH

FIELD OF THE INVENTION

The invention relates generally to radio-frequency (RF) switching circuits. More specifically, but without limitation, the invention relates to RF switching circuits employing PIN diodes in a series and series-shunt single-pole, single-throw (SPST) configuration for use in applications such as plasma processing systems.

BACKGROUND OF THE INVENTION

Single-pole, single-throw (SPST) PIN diode switches provide a convenient way of coupling a single input signal to one of a plurality of output terminals. Such a flexibly configurable topology can be used, for example, in plasma processing systems in which one high-power radio-frequency (RF) generator can be used as an energy source for a plurality of plasma chambers or for different electrodes of the same plasma chamber. For RF generators feeding plasma processing systems, the transmitted power can be very high—as much as 5 kW or more. Furthermore, the reliability and stability of the switch can impact the performance of plasma processing equipment.

PIN diode SPST switches are completely electronic and, therefore, inherently present various feedback paths between the output terminals of the switch. Many applications require at least about 40 dB of signal isolation between output ports serviced by the same input port. A circuit that would combine the versatility of high power transmitted power with advanced isolation characteristics and stability would have a multitude of applications.

FIG. 1 shows a typical configuration of a PIN diode SPST ("switch") 100. When switch 100 is "closed" (configured to allow current to flow), PIN diode 105 is forward biased, presenting a very low impedance to the RF signal passing from input terminal 110 to the output terminal 115. DC voltage sufficient to forward bias PIN diode 105 is applied to control port 120 and creates DC current flowing through DC-conducting and RF-isolating element 125, PIN diode 105, and DC-conducting and RF-isolating element 130. DC-conducting and RF-isolating elements 125 and 130 have low DC impedance for the biasing current and high RF impedance at their points of connection with PIN diode 105. When switch 100 is closed, PIN diode 135 is reverse biased, presenting very high impedance to the RF signal and having negligible shunting action to the output of the switch.

When switch 100 is "open" (configured to prevent current from flowing), PIN diode 105 is reverse biased, presenting very high impedance to the RF signal passing from input terminal 110 to output terminal 115. But the junction capacitance of PIN diode 105 allows a significant portion of the coupled microwave signal to pass through switch 100 when switch 100 is in the "open" position. In the very-high-frequency (VHF) range, the junction capacitance can limit isolation between input terminal 110 and output terminal 115 to only 20 to 25 db. Forward biased PIN diode 135 provides a low impedance shunt from output terminal 115 to ground 140, improving isolation to at least 40 db. The bias of PIN diode 135 is controlled by control port 145.

Capacitors 150, 155, 160, and 165 are all blocking capacitors, meaning they have low impedance at the operational frequency and do not affect the transmission and isolation properties of switch 100. In VHF frequency range, lumped circuit elements (multi-turn coils) are typically used as the DC-conducting and RF-isolating elements 125 and 130. But in the configuration shown in FIG. 1, the full RF voltage is applied to the coils. At a transmitted power level of a few kilowatts, this voltage can reach many hundreds of volts. In VHF range, such a high voltage usually results in considerable thermal problems for the multi-turn coils. To handle such a high RF voltage, the coils need a very low loss factor (hence big size) and require a complex cooling system. Another drawback of the coils is low temperature stability and long-term mechanical instability if expensive mechanical constructions are not used. These factors limit using lumped circuit elements for high-power and high-reliability systems.

One of the requirements for DC-conducting and RF-isolating elements 125 and 130 is high RF impedance at operational frequency. Some prior-art high-power PIN diode switches are implemented using a distributed, constant-transmission-circuit, quarter-wavelength, resonant transmission line. This type of RF-isolating element is used in narrow-band applications, which is typically the case with plasma processing systems. The impedance of the shorted-at-the-end, quarter-wavelength, resonant transmission line at resonant frequency theoretically should be infinite, but due to the finite resistance of the material of which the transmission line is made and dielectric losses in the isolation, the actual impedance can be considerably low. DC-conducting and RF-isolating elements 125 and 130 are connected in parallel to input terminal 110 and output terminal 115, and the low input impedance of DC-conducting and RF-isolating elements 125 and 130 means high RF energy loss in those elements.

Transmission lines can be realized using microstrip technology on thermally conductive substrates. This allows dissipating sufficient power in the DC-conducting and RF-isolating elements and operating at higher transmitted power. Using ceramic substrates provides high stability and reliability for the switch. But switches employing quarter-wavelength, resonant transmission lines have significant drawbacks. In VHF frequency applications, the length of the quarter-wavelength segments is large compared to the remainder of the circuit. Therefore, the size of the housing and the length of the conductors for the switch are increased compared to other switches.

To decrease the size of the housing for the quarter-wavelength circuit, the folded stripline shape is used frequently. FIG. 2A shows one example of a quarter-wavelength circuit 200 in which the stripline 205 has a meandering (snake-like) shape. Stripline 205 is disposed onto thermoconductive substrate 210, which is thermally attached to heat sink 215. Other elements of the PIN diode switch (the PIN diode itself, the capacitors, and the RF and bias-control ports) are also disposed on the same thermoconductive substrate 210, but those elements are not shown in FIG. 2A for simplicity.

The isolation properties of the folded stripline 205 deteriorate when the distance between adjacent sections of the folded stripline 205 becomes less than or equal to the width of the folded stripline 205. The reason for this is that the configuration of the magnetic field of the folded stripline 205 is different from that of a straight stripline. RF currents in adjacent sections of a folded stripline flow in opposite directions. This is shown schematically in the cross-section A-B of FIG. 2B, in which the directions of current flow are shown above the sections of folded stripline 205 as circled crosses (into the page, away from the reader) and circled dots (out of the page, toward the reader). Adjacent sections of folded stripline 205 are coupled magnetically, and that magnetic coupling "M" results in the partial cancellation of the magnetic fields of adjacent sections. As a result, the characteristic impedance of the transmission line decreases, and the electrical length of the line decreases, requiring that the physical length of the stipline be increased to satisfy the quarter-wavelength, resonant conditions. All those changes increase RF energy losses in the line. Those effects can impose a practical limit on the extent to which the size of the stripline can be compacted.

Although the technical solutions of the prior art discussed above provide significant improvements in the art, there remains an ongoing need for further improvements in the design of high-power microwave switches, particularly for very high power applications involving plasma processing with transmitted power up to 5 kW in the VHF frequency range.

SUMMARY OF THE INVENTION

Illustrative embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present invention can provide a high-power PIN diode switch for use in applications such as plasma processing systems. One illustrative embodiment is a PIN diode switch comprising an input terminal; an output terminal; and first and second transmission-line elements connected in parallel to the input and output terminals, each of the first and second transmission-line elements including a thermoconductive dielectric substrate and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections. These and other embodiments are described in greater detail herein.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings, wherein:

DETAILED DESCRIPTION

In one illustrative embodiment of the invention, a PIN diode single-pole, single-throw (SPST) switch is provided that has low cost, high stability and reliability, and small size. The PIN diode switch comprises a series PIN diode and direct-current (DC) biasing circuit in which DC-conducting and radio-frequency (RF)-isolating elements are microstrip-line-type, folded, quarter-wavelength, resonant transmission lines including a plurality of substantially parallel sections that are magnetically coupled and electrically connected in series. The substantially parallel sections are arranged in a manner that mutually reinforces their local magnetic fields. This results in an increase in the characteristic impedance and a decrease in the RF losses of the microstrip line.

The closer the adjacent substantially parallel sections are placed to each other, the stronger the interaction between their magnetic fields, the smaller the RF losses, and the smaller the size of the resonant transmission line. Lower loss and smaller size allow the PIN diode switch to operate more reliably and to be assembled in smaller and less expensive housing.

Figure 3:
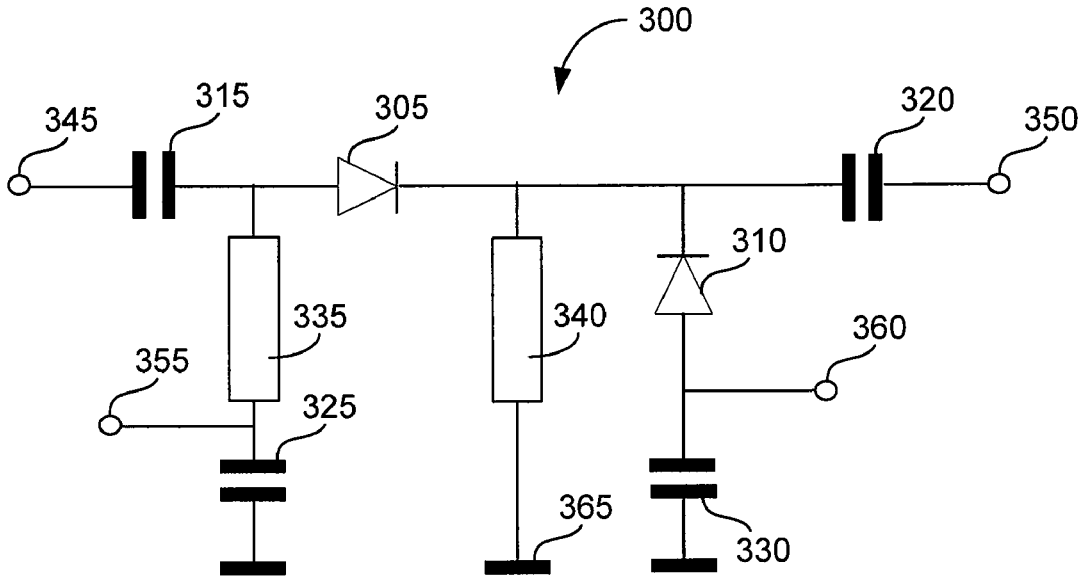
FIG. 3 is a circuit diagram of a PIN diode switch in accordance with an illustrative embodiment of the invention.

Referring now to the drawings, where like or similar elements are designated with identical reference numerals throughout the several views, and referring in particular to FIG. 3, it is a circuit diagram of a PIN diode switch 300 in accordance with an illustrative embodiment of the invention. The circuit of FIG. 3 includes PIN diodes 305 and 310; blocking capacitors 315, 320, 325, and 330; and transmission-line elements 335 and 340. In this particular embodiment, transmission-line elements 335 and 340 are microstrip-line-type, folded, quarter-wavelength, resonant transmission lines. Input RF power is fed to input terminal 345, and output RF power is taken from output terminal 350. Control port 355 provides a terminal for biasing PIN diode 305. Control port 360 provides a terminal for biasing PIN diode 310. For simplicity, the circuit making up the bias controller is not shown in FIG. 3 but is within the capability of one of ordinary skill of the art to design. The transmission and isolation modes of operation of a series-shunt SPST switch in general are described above.

To aid thermal management in the illustrative embodiment shown in FIG. 3, all elements are disposed on a highly thermally conductive, electrically isolating substrate such as aluminum oxide ceramic. All interconnections and quarter-wavelength, resonant transmission-line elements 335 and 340 are fabricated using microstrip technology. Blocking capacitors 315, 320, 325, and 330 and PIN diodes 305 and 310 are disposed on the same substrate using surface-mount soldering technology.

Figure 1:
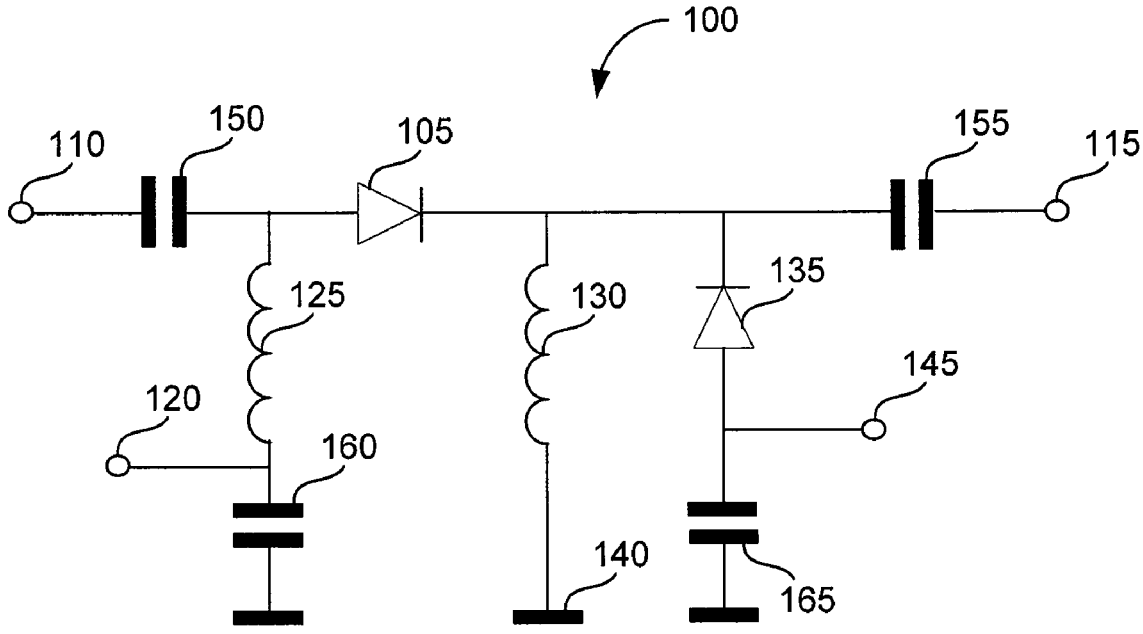
FIG. 1 (Prior Art)
FIG. 1 is a circuit diagram of a high-power PIN diode switch according to the prior art.
Figure 2A:
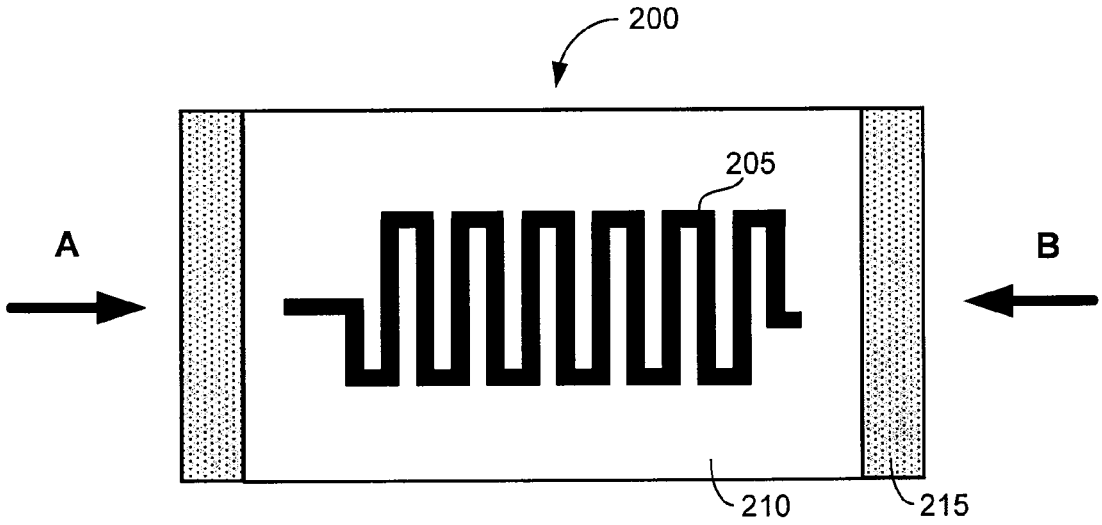
FIG. 2A (Prior Art)
FIG. 2A is a top view of a quarter-wavelength, resonant transmission-line element according to the prior art.
Figure 2B:
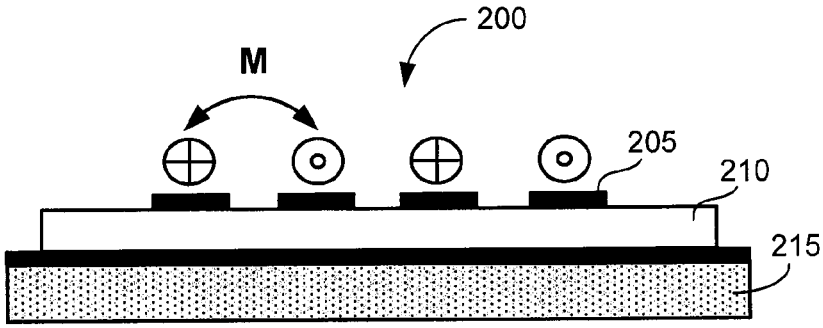
FIG. 2B (Prior Art)
FIG. 2B is a cross-sectional side view of the quarter-wavelength, resonant transmission-line element shown in FIG. 2A according to the prior art.

To minimize the size of PIN diode switch 300, transmission-line elements 335 and 340 are implemented using a folded design, but the folded design differs from the prior-art meandering shape shown in FIG. 2A. To compensate for the harmful effects of the close proximity of adjacent sections of the line, the topology of the sections is configured in such a way that the local magnetic field of each individual section increases (constructively interferes with) the magnetic field of adjacent sections.

Figure 4A:
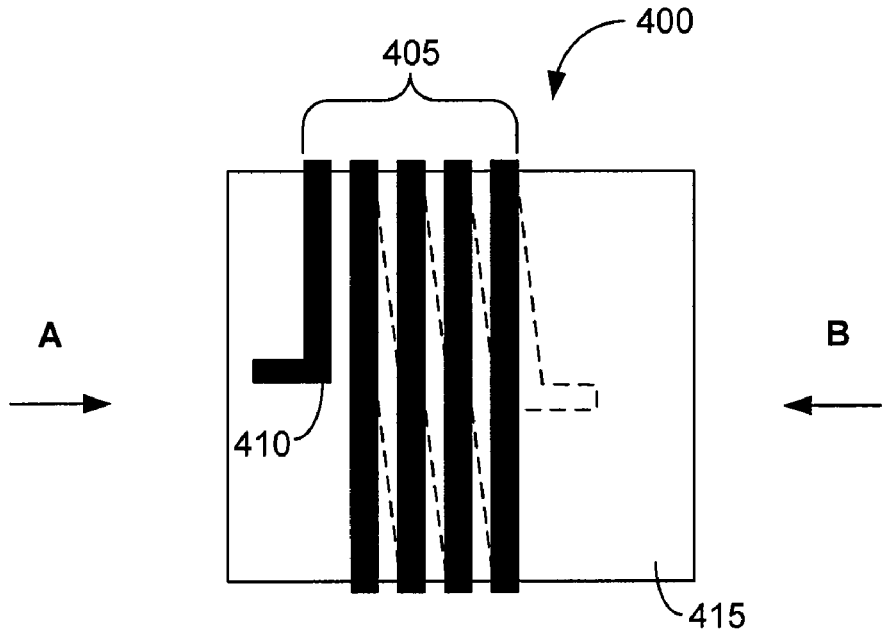
FIG. 4A is a top view of a transmission-line element in accordance with an illustrative embodiment of the invention.

FIG. 4A is a top view of a transmission-line element 400 in accordance with an illustrative embodiment of the invention. In this embodiment, transmission-line element 400 is a quarter-wavelength, resonant transmission line. A cross-section A-B of transmission-line element 400 is shown in FIG. 4B.

Figure 4B:
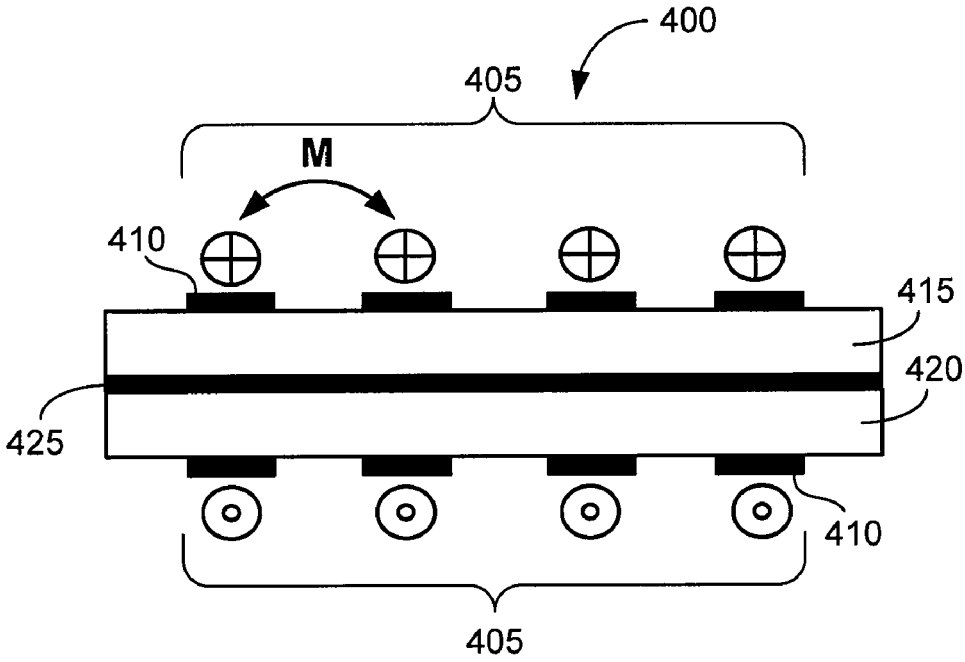
FIG. 4B is a cross-sectional side view of the transmission-line element shown in FIG. 4A in accordance with an illustrative embodiment of the invention.

Referring to both FIGS. 4A and 4B, substantially parallel sections ("sections") 405 of transmission-line element 400 are formed by printing an electrically conductive trace (e.g., a microstrip line) 410 on the surface of thermoconductive insulating substrates 415 and 420 such as aluminum oxide. The electrically conductive trace 410 can be composed of any suitable conductor such as copper, aluminum or alloys. The two thermoconductive insulating substrates (415 and 420) are assembled together, as shown in FIG. 4B. The substrates 415 and 420 are separated by an electrically conductive ground plane 425. In one embodiment, a printed metallization layer on the opposite side of at least one substrate provides ground plane 425.

Sections 405 of the trace 410 associated with substates 415 and 420 are connected electrically in series (e.g., through the use of jumpers). Trace 410, however, is electrically isolated from ground plane 425. In this embodiment, trace 410 is effectively "wrapped around" the attached substrates 415 and 420. As indicated in FIG. 4B, RF currents in adjacent sections 405 of trace 410 flow in the same direction on a given substrate 415 or 420. In FIG. 4B, the circled crosses above the sections 405 associated with substrate 415 indicate current flow into the page, away from the reader. The circled dots below the sections 405 associated with substrate 420 indicate current flow out of the page, toward the reader. In this case, the magnetic coupling M results in a mutual increase of the magnetic fields of adjacent sections 405. Because the substrates 415 and 420 are separated magnetically and electrically from ground plane 425, there is no electromagnetic interaction between the two sides of the assembly.

The mutually reinforced magnetic field of the plurality of substantially parallel sections 405 exceeds that of a straight line. At the same time, the distribution of the electric field of each section 405 of the line remains almost the same as for the straight line because the major part of the energy of the electric field is confined in the body of the substrate between the trace and ground plane 425. But the ratio of magnetic field energy to electric field energy defines the characteristic impedance of the transmission line. Consequently, the characteristic impedance of a folded transmission line constructed in accordance with the principles of the invention becomes higher than that of a straight line. This means an increase in input impedance of the transmission-line element and a proportional decrease in energy loss.

The illustrative embodiment shown in FIGS. 4A and 4B is well suited for applications in which PIN diode switch 400 controls a moderate level of RF power and air cooling is sufficient to remove the thermal power dissipated by the elements of the switch.

Figure 5A:
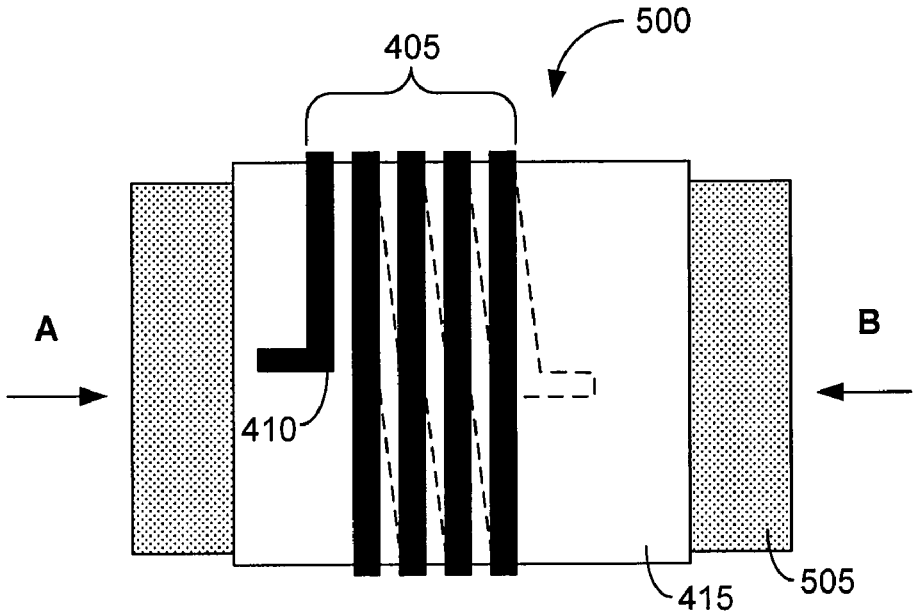
FIG. 5A is a top view of a transmission-line element in accordance with another illustrative embodiment of the invention.
Figure 5B:
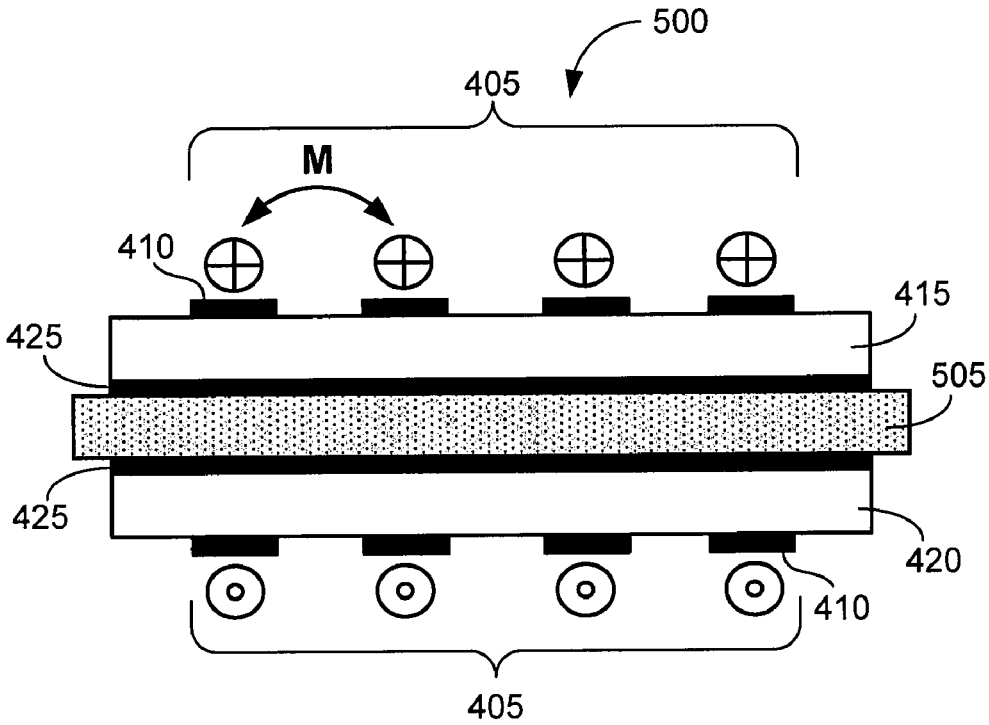
FIG. 5B is a cross-sectional side view of the transmission-line element shown in FIG. 5A in accordance with this illustrative embodiment of the invention.

FIG. 5A is a top view of a transmission-line element 500 in accordance with another illustrative embodiment of the invention. A cross-section A-B of transmission-line element 500 is shown in FIG. 5B. The embodiment shown in FIGS. 5A and 5B, which is similar to that shown in FIGS. 4A and 4B, includes a heat sink 505 between substrates 415 and 420. Using a water-cooled heat sink allows more power to be dissipated. Therefore, the PIN diode switch 500 can control higher RF power.

Figure 6A:
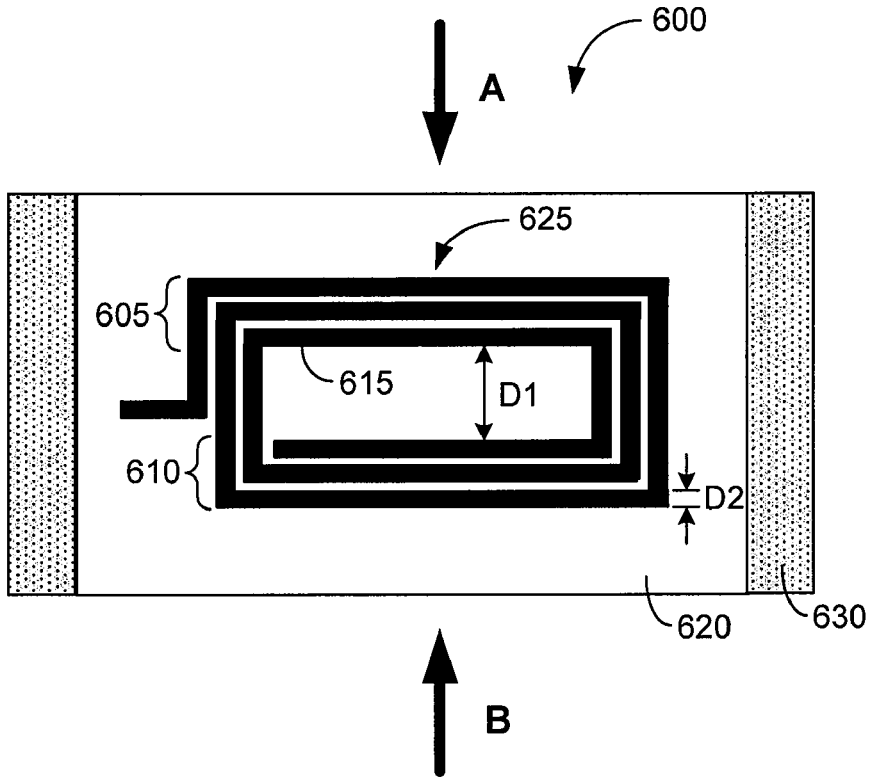
FIG. 6A is a top view of a transmission-line element in accordance with yet another illustrative embodiment of the invention.
Figure 6B:
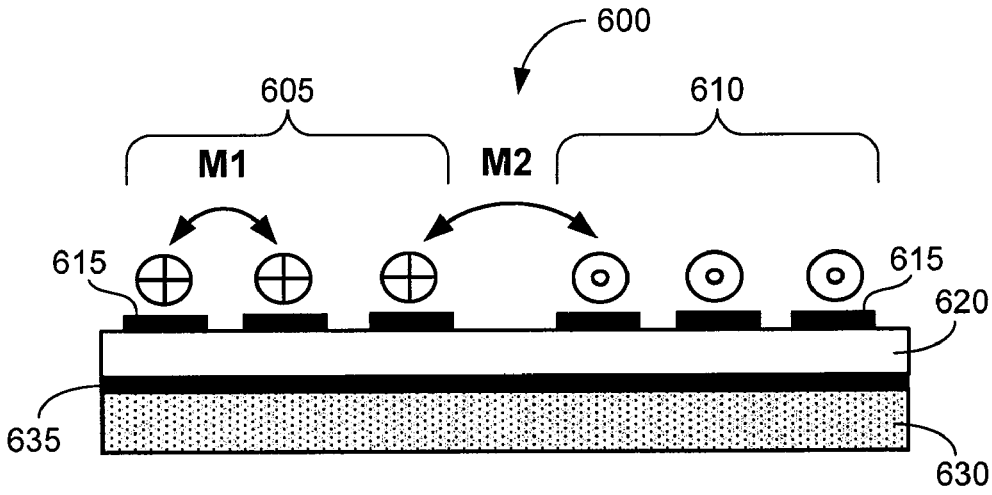
FIG. 6B is cross-sectional side view of the transmission-line element shown in FIG. 6A in accordance with this illustrative embodiment of the invention.

FIG. 6A is a top view of a transmission-line element 600 in accordance with yet another illustrative embodiment of the invention. A cross-section A-B of transmission-line element 600 is shown in FIG. 6B. In this embodiment, two or more spatially separated groups (605 and 610) of substantially parallel sections 615 of the transmission line are disposed on a single planar surface. Within each group of substantially parallel sections, the direction of RF current flow is the same, causing the local magnetic field of the sections in that group to be mutually reinforced. In the particular example of FIGS. 6A and 6B, two spatially separated groups are employed, and the distance between those two groups of sections 605 and 610 ("D1" in FIG. 6A) is made sufficiently larger than the width of trace 625 ("D2" in FIG. 6A) to render negligible the magnetic coupling between the groups 605 and 610. Thus, the magnetic coupling M2 has a negligible effect on the total magnetic field configuration compared to the much stronger magnetic coupling M1. In some embodiments, the substrate is attached to a heat sink 630. In this embodiment, trace 625 is shown as a rectangular spiral. However, a rectangular spiral is shown only for illustration purposes. Other shapes are also realizable.

Figure 7:
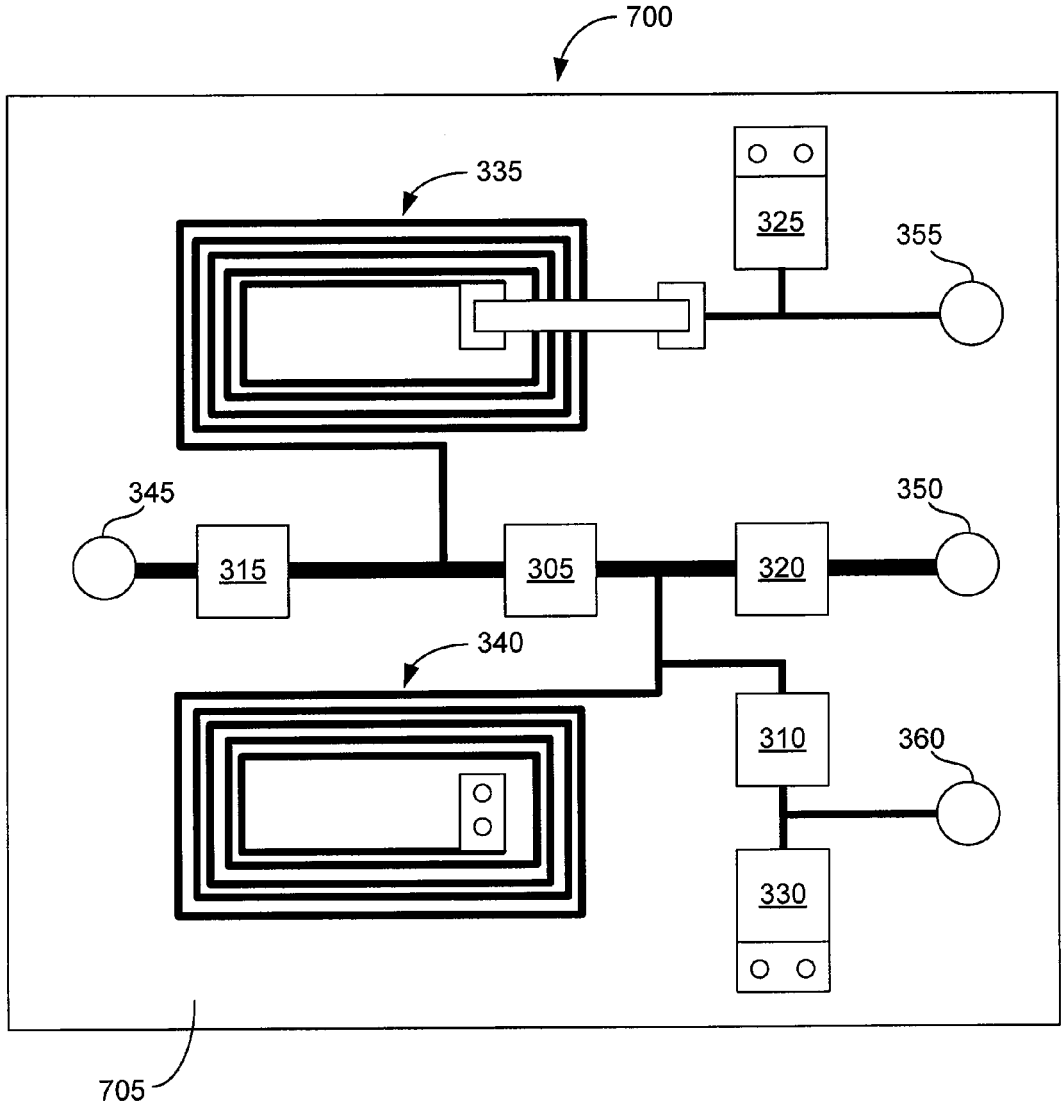
FIG. 7 is a top view of high-power PIN diode switch in accordance with an illustrative embodiment of the invention.

FIG. 7 is a top view of a high-power PIN diode switch 700 in accordance with an illustrative embodiment of the invention. The elements shown in FIG. 7 corresponding to those shown in FIG. 3 are designated by the same reference numerals. In this particular embodiment, the quarter-wavelength, resonant transmission-line elements 335 and 340 are constructed in a single-plane fashion, as discussed in connection with FIGS. 6A and 6B. The grounded terminals of capacitors 320 and 325 and transmission-line element 340 are connected to a ground plane 635 (not shown in FIG. 7) disposed on the other side of substrate 620 (see FIGS. 6A and 6B) by way of vias (through holes). The components of PIN diode switch 700 are disposed on a thermoconductive dielectric substrate 705.

By way of illustration, one particular implementation of a PIN diode switch in accordance with the principles of the invention has overall dimensions of 50 mm×100 mm×15 mm. This PIN diode switch has an operating frequency range from 55 MHz to 65 MHz. Two such PIN diode switches installed at the output of an RF generator provide switching of 5 kW of RF power between two independent loads. The insertion loss measured under these conditions remains below 0.05 dB. The isolation between two outputs measured at the 5-kW level is greater than 45 dB.

A PIN diode switch according to the invention is simple in structure and, as such, is inexpensive, yet it is capable of providing excellent performance.

In conclusion, the present invention provides, among other things, a high-power PIN diode switch suitable for applications such as plasma processing systems. Those skilled in the art can readily recognize that numerous variations and substitutions may be made in the invention, its use, and its configuration to achieve substantially the same results as achieved by the embodiments described herein. Accordingly, there is no intention to limit the invention to the disclosed illustrative forms. Many variations, modifications and alternative constructions fall within the scope and spirit of the disclosed invention as expressed in the claims.

What is claimed is:

1. A PIN diode single-pole, single-throw switch, comprising:

an input terminal;

an output terminal; and first and second transmission-line elements connected in parallel to the input and output terminals, each of the first and second transmission-line elements including:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections;

wherein adjacent substantially parallel sections of each of the first and second transmission lines are separated by a predetermined distance, each substantially parallel section has a predetermined width, and the predetermined distance is less than or equal to the predetermined width.

2. The PIN diode switch of claim 1, wherein the microstrip line has a predetermined length to provide a substantially equivalent one-quarter-wavelength transmission line.

3. The PIN diode switch of claim 1, wherein the plurality of substantially parallel sections are disposed on an outer surface of each of two thermoconductive dielectric substrates, an inner surface opposite the outer surface of at least one of the two thermoconductive dielectric substrates having an electrically conductive coating, the inner surfaces of the two thermoconductive dielectric substrates being attached to each other.

4. The PIN diode switch of claim 1, wherein the plurality of substantially parallel sections are disposed on an outer surface of each of two thermoconductive dielectric substrates, an inner surface opposite the outer surface of each thermoconductive dielectric substrate having an electrically conductive coating, the inner surfaces of the two thermoconductive dielectric substrates being attached to opposing surfaces of a heat sink.

5. The PIN diode switch of claim 1, wherein the plurality of substantially parallel sections are divided into at least two spatially separated groups on a single surface of the thermoconductive dielectric substrate and the thermoconductive dielectric substrate has an electrically conductive coating on a surface opposite the single surface.

6. A PIN diode single-pole, single-throw switch, comprising:

an input terminal;

an output terminal; and first and second transmission-line elements connected in parallel to the input and output terminals, each of the first and second transmission-line elements including:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections;

wherein the plurality of substantially parallel sections are divided into at least two spatially separated groups on a single surface of the thermoconductive dielectric substrate and the thermoconductive dielectric substrate has an electrically conductive coating on a surface opposite the single surface;

wherein the at least two spatially separated groups are separated by a predetermined distance sufficient to render negligible the magnetic coupling between the at least two spatially separated groups.

7. The PIN diode of claim 6, wherein the microstrip line of each of the first and second transmission lines is arranged in a rectangular spiral.

8. The PIN diode of claim 6, wherein the surface of the thermoconductive dielectric substrate opposite the single surface is attached to a heat sink.

9. A PIN diode switch, comprising:

a first capacitor coupled to an input terminal at a first end of the first capacitor and to a first common node at a second end of the first capacitor;

a second capacitor coupled to an output terminal at a first end of the second capacitor and to a second common node at a second end of the second capacitor;

a third capacitor coupled to a third common node at a first end of the third capacitor and to ground at a second end of the third capacitor;

a fourth capacitor coupled to a fourth common node at a first end of the fourth capacitor and to ground at a second end of the fourth capacitor;

a first PIN diode connected between the first common node and the second common node, an anode of the first PIN diode being connected with the first common node, a cathode of the first PIN diode being connected with the second common node;

a second PIN diode connected between the second common node and the fourth common node, a cathode of the second PIN diode being connected with the second common node, an anode of the second PIN diode being connected with the fourth common node;

a first control terminal connected with the third common node to provide variable bias control to the first PIN diode;

a second control terminal connected with the fourth common node to provide variable bias control to the second PIN diode;

a first transmission line coupled to the first common node at a first end of the first transmission line and to the third common node at a second end of the first transmission line; and a second transmission line coupled to the second common node at a first end of the second transmission line and to ground at a second end of the second transmission line;

wherein:

each of the first and second transmission lines is formed as a microstrip line disposed on a thermoconductive dielectric substrate;

the microstrip line forming each of the first and second transmission lines includes a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections; and each of the first and second transmission lines has a predetermined length to provide a substantially equivalent one-quarter-wavelength transmission line.

10. The PIN diode switch of claim 9, wherein the first, second, third, and fourth capacitors and the first and second PIN diodes are surface mounted on the thermoconductive dielectric substrate.

11. A transmission-line element for a PIN diode switch, the transmission-line element comprising:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections;

wherein adjacent substantially parallel sections are separated by a predetermined distance, each substantially parallel section has a predetermined width, and the predetermined distance is less than or equal to the predetermined width.

12. The transmission-line element for a PIN diode switch of claim 11, wherein the microstrip line has a predetermined length to provide a substantially equivalent one-quarter-wavelength transmission line.

13. The transmission-line element for a PIN diode switch of claim 11, wherein the plurality of substantially parallel sections are disposed on an outer surface of each of two thermoconductive dielectric substrates, an inner surface opposite the outer surface of at least one of the two thermoconductive dielectric substrates having an electrically conductive coating, the inner surfaces of the two thermoconductive dielectric substrates being attached to each other.

14. The transmission-line element for a PIN diode switch of claim 11, wherein the plurality of substantially parallel sections are disposed on an outer surface of each of two thermoconductive dielectric substrates, an inner surface opposite the outer surface of each thermoconductive dielectric substrate having an electrically conductive coating, the inner surfaces of the two thermoconductive dielectric substrates being attached to opposing surfaces of a heat sink.

15. A transmission-line element for a PIN diode switch, the transmission-line element comprising:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections;

wherein the plurality of substantially parallel sections are divided into at least two spatially separated groups on a single surface of the thermoconductive dielectric substrate and the thermoconductive dielectric substrate has an electrically conductive coating on a surface opposite the single surface;

wherein the at least two spatially separated groups are separated by a predetermined distance sufficient to render negligible the magnetic coupling between the at least two spatially separated groups.

16. The transmission-line element for a PIN diode switch of claim 15, wherein the microstrip line is arranged in a rectangular spiral.

17. A transmission-line element for a PIN diode switch, the transmission-line element comprising:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections;

wherein the plurality of substantially parallel sections are divided into at least two spatially separated groups on a single surface of the thermoconductive dielectric substrate and the thermoconductive dielectric substrate has an electrically conductive coating on a surface opposite the single surface;

wherein the surface of the thermoconductive dielectric substrate opposite the single surface is attached to a heat sink.

18. A very-high-frequency (VHF)-band plasma processing system, comprising:

a radio-frequency (RF) power supply;

a load; and a PIN diode switch to couple selectively the RF power supply to the load, the PIN diode switch including first and second transmission-line elements, each of the first and second transmission line elements including:

a thermoconductive dielectric substrate; and a microstrip line disposed on the thermoconductive dielectric substrate, the microstrip line including a plurality of substantially parallel sections that are magnetically coupled, electrically connected in series, and arranged so that electrical current flows in substantially the same direction in adjacent substantially parallel sections to mutually reinforce the magnetic fields associated with the adjacent substantially parallel sections, the microstrip line having a predetermined length to provide a substantially equivalent one-quarter-wavelength transmission line.

19. The apparatus of claim 18, wherein the PIN diode switch is a single-pole, single-throw (SPST) switch.

* * * * *